US008076561B2

(12) United States Patent
Stevens et al.

(10) Patent No.: US 8,076,561 B2
(45) Date of Patent: Dec. 13, 2011

(54) METHODS AND APPARATUS FOR VIBRATO EFFECTS IN KEYBOARD PERCUSSION MUSICAL INSTRUMENTS

(75) Inventors: Leigh Howard Stevens, Neptune, NJ (US); Josef Eberl, Winterthur (CH); Roger Clerc, Oberweningen (CH)

(73) Assignee: Leigh H. Stevens, Neptune, NJ (US)

( * ) Notice: Subject to any disclaimer, the term of this patent is extended or adjusted under 35 U.S.C. 154(b) by 0 days.

(21) Appl. No.: 12/687,448

(22) Filed: Jan. 14, 2010

(65) Prior Publication Data

US 2010/0116120 A1 May 13, 2010

Related U.S. Application Data

(63) Continuation of application No. 11/767,814, filed on Jun. 25, 2007, now Pat. No. 7,732,691.

(51) Int. Cl.
*G10D 13/08* (2006.01)

(52) U.S. Cl. ..... 84/403; 84/410

(58) Field of Classification Search ..... 84/403
See application file for complete search history.

(56) References Cited

U.S. PATENT DOCUMENTS

| | | | | |
|---|---|---|---|---|
| 1,807,057 | A | | 5/1931 | Bowers |
| 1,843,553 | A | | 2/1932 | Gladstone |
| 2,556,342 | A | | 6/1951 | Dickran |
| 2,795,162 | A | | 6/1957 | Eash |
| 3,138,986 | A | * | 6/1964 | Musser ..... 84/410 |
| 3,649,737 | A | | 3/1972 | Jespersen |
| 3,742,984 | A | * | 7/1973 | Wilkins et al. ..... 137/629 |
| 3,807,345 | A | * | 4/1974 | Peterson ..... 440/7 |
| 3,858,477 | A | | 1/1975 | Kawakami |
| 4,324,164 | A | * | 4/1982 | Monte et al. ..... 84/744 |
| 4,570,525 | A | | 2/1986 | Suzuki |
| 4,619,178 | A | * | 10/1986 | Kondoh ..... 84/410 |
| 4,913,023 | A | | 4/1990 | Mizuguchi et al. |
| 4,941,386 | A | | 7/1990 | Stevens |
| 5,189,236 | A | | 2/1993 | Stevens |
| 5,977,465 | A | | 11/1999 | Piper |
| 7,361,822 | B1 | | 4/2008 | Hsieh |
| 2002/0073824 | A1 | | 6/2002 | Adams |

OTHER PUBLICATIONS

"Vander Plas Percussion Discussion Board Web Pages," retrieved on Jan. 8, 2007 (pp. 1-9).

* cited by examiner

*Primary Examiner* — Elvin G Enad
*Assistant Examiner* — Christopher Uhlir
(74) *Attorney, Agent, or Firm* — Grossman Tucker Perreault & Pfleger, PLLC

(57) ABSTRACT

Improved methods and apparatus of producing vibrato on keyboard percussion/tone bar instruments such as the vibraphone and marimba are provided. Means are disclosed for real time control of the expressive qualities of both the speed and strength of the vibrato of such instruments, while eliminating the need for an electrical motor. According to certain embodiments, methods and apparatus are disclosed to easily produce a change of dynamic level (crescendo and diminuendo) after a single strike of a tone bar or chord.

25 Claims, 9 Drawing Sheets

METHODS AND APPARATUS FOR VIBRATO EFFECTS IN KEYBOARD PERCUSSION MUSICAL INSTRUMENTS

TECHNICAL FIELD

Embodiments of the present invention generally relate to keyboard percussion instruments, such as vibraphones and marimbas. In particular one or more embodiments relate to methods and apparatus to control and modulate vibrato effects in keyboard percussion instruments.

BACKGROUND

Keyboard percussion instruments, such as vibraphones and marimbas, are musical instruments that have tone bars and are played upon by musicians with mallets. Keyboard percussion instruments of the type played on by hand-held mallets fall into two distinct categories. non-resonator instruments such as the glockenspiel (orchestra bells) and chimes (tubular bells); and resonated instruments such as the marimba, xylophone and vibraphone ("vibes").

Resonated instruments such as the vibraphone have resonators, usually a tube, acoustically coupled with a tone bar. The resonators of keyboard percussion instruments serve to amplify the sound of the tone bar above. Instruments of this genre that have long ringing aluminum or steel bars, such as the vibraphone and glockenspiel, often have a dampening system to allow the player to control the ring time of the bar, usually through the operation of a foot pedal. This pedal operates similarly to the sustain pedal of a piano. Pressing the pedal removes the damper bar from the keyboard; releasing the pedal allows it to return to its former dampening position, usually by means of a spring mechanism.

The vibraphone frequently has one feature which is unique to it, and which is the basis for its name, which is a spinning pulsar disk in a resonator tube. A diagram of this is shown in FIG. 1. Positioned in the upper portion of a resonator tube 101 in FIG. 1 is a set of rotating or spinning pulsar/fans 102 in FIG. 1 is an example, mounted on an axle or pulsar fan shaft 103, powered by an electric motor 104. These spinning disks open and close the top opening of the resonators, producing the distinctive steady vibrato sound. In the existing version of the vibraphone, the vibrato strength varies steadily with each rotation of the disks inside the resonators, from substantially closed tubes, with the pulsar disks in the horizontal position, as shown in FIG. 2*a*, with the pulsar disk moving to an intermediate position as shown in FIG. 2*b*, and with the pulsar disk in the substantially open position as shown in FIG. 2*c*. Some efforts are known to attempt to provide control to a musician to stop disks at a pre-set angle. For instance, U.S. Pat. No. 4,619,178, issued on Oct. 28, 1986 and entitled Stop Angle Controller for a Vibrato Mechanism on a Vibraphone, discloses an electronic system for setting a stop angle for a pulsar disk.

In the existing version of the vibraphone, the speed of the vibrato may be controlled by adjusting the rotation of the electric motor, but with almost no possibility for the player to precisely control the vibrato speed to match the underlying rhythm of the music or to adjust the speed on an instantaneous basis to match the expressive needs of an individual note, chord or moment in the music.

Existing vibrato mechanisms have some additional significant shortcomings. In all forms of the existing vibrato mechanism used in keyboard percussion instruments, the mechanism that produces the vibrato effect blocks a substantial portion of the resonance of the tube. This is because the pulsar fans and the shaft on which they are mounted are both located within the resonator itself. Even in the full open position, half of the pulsar fan is down in the tube and the other half of it is directly above the tube, partially blocking the acoustics of the tube from the tone bar.

In this open position, where maximum resonance is desirable, the pulsar disks and shaft interfere with the sympathetic resonance of the tone bar and tube, the coupling of which is the essence of the sound of resonated keyboard percussion instruments. The existing art has a further disadvantage: In the closed position, the resonator is never really closed off from the tone bar because of the clearance necessary between the circumference of the pulsar disks and the inside diameter of the tubes. In this closed position there is always leakage around the pulsar disk into the resonator.

Thus, even in well made, carefully engineered instruments, the existing method of producing vibrato never produces the full potential range of vibrato. It never reaches full potential maximum volume when open, nor potential minimal volume when closed.

If the disk and tube were engineered to closely mate in size so as to minimize leakage around the disk, any slight misalignment of any of the thirty-seven (37) disks on a 3-octave instrument would produce unacceptable noise levels. It is a well-known problem with keyboard percussion instruments that even in loosely mated designs, the spinning disks and shaft are often too noisy to use in soft musical passages. Thus, in the precise musical environment where vibrato would be most appropriate (soft ballads and other sustained musical styles), the noisy, existing methods of producing vibrato make it impossible for the musician to consider. Turning the electric motor on frequently results in the sound of a decidedly unmusical chatter of clicking and spinning of fans in tubes.

Another disadvantage of the existing methods of producing vibrato is that the upper open ends of the resonator tubes (nearest to the tone bars) must be notched out or otherwise deformed to accommodate the pulsar fan shaft. See for instance notch 300 in FIGS. 2*a*-2*c* as an illustration of this. This notching of the tubes weakens the resonance, adds undesirable non-harmonic overtones to the remaining resonance and detunes the resonator's frequency from the natural tone that would be obtained by a tube that had an unaltered cylindrical shape The full vibrato effect (100% resonated volume to 0% resonated volume and back to 100%) has never been achieved through prior art because the pulsar fan assembly never fully closes the resonator, nor allows for a fully resonated tone. The existing methods are also inherently noisy since they involve power provided by an electric motor that spins a long assembly of disks inside of the resonators. As a result of these well-known shortcomings, vibraphones are often ordered without the "vibes" (that is: without the motor and pulsar disk assembly).

In recent years, improvements have been made to the pulsar fan mechanism of vibraphones. These improvements were mostly of a mechanical nature: attempting to make the motor run more quietly through the use of higher-quality bearings on the pulsar fan shaft; the use of timing belts (rather than simple pulleys) to keep the two sets of pulsar disks phase-aligned (the pulsar disks in the sharp and natural resonator tubes are open and closed in phase with one another); devices to assure that the pulsars stop rotating in the open position when the motor is turned off; etc. However, all of these developments have been refinements of the same motor-driven mechanism that has been manufactured worldwide for more than 70 years and they do not address the inherent weaknesses of the system.

Another weakness of the current motor-driven vibrato system is the interface between the player and the vibrato mechanism. The sound of a vibraphone (or similarly-equipped marimba or other keyboard percussion instrument), when the pulsar disks are spinning powered by an electrical motor, is comprised of a steady-speed, mechanical, non-expressive vibrato that does not respond instantaneously to the musical desires of the player. The motor can be sped up or slowed down by manipulating the controls, but matching a particular rhythm, or enhancing individual notes within a phrase in a controlled manner is impossible, even with existing recent interfaces between player and electric motor. Even if the motor speed could be set with metronome-like precision, it would not follow the moment-to-moment bending of tempo, which is common in musical performance, nor could it respond to the creative whims of a jazz musician. It should be appreciated by one of ordinary skill in the art that the current electro-mechanical method of controlling the speed of vibrato is primitive and it lacks the refined speed control available to other instrumentalists or vocalists.

Vibrato has the dimension or quality of "depth" or "strength" in addition to the more obvious dimension of speed. With respect to keyboard percussion instruments, the perception of "depth" of vibrato is directly related to the volume or strength of resonance of the tone bar and tube. Current art does not permit variations of strength of vibrato. As the pulsar fans rotate on the shaft at the set speed of the motor, the strength or "depth" of the resonance varies in exactly the same way with each rotation—vertical/open followed by horizontal/closed. The volume levels achieved by the present rotational method are approximately 85-90% of maximum resonance when open, down to approximately 10-15% of the minimum resonance when closed. There is no possibility for the musician to even contemplate a vibrato comprised of 70% open/25% open and 70% open/25% open, or to progressively cycle through a musical crescendo of, for example, 5% open/10% open, 5% open/20% open, 5% open/40% open and so forth. There are a myriad of musical possibilities and applications for varying the depth of vibrato, and all are beyond the capabilities of the current art of keyboard percussion vibrato.

In contrast to the tone of the vibraphone, the vibrato of any string instrument or the human voice modulates in speed and depth according to the expressive musical desires of the performer. Sometimes the vibrato gets faster or slower as a note is sustained, sometimes it is completely absent in the beginning of a note and then gradually added toward the end, as is often heard on held notes in popular ballade singing. The vibraphone or any keyboard percussion instrument in its present form is incapable of any such musical expression because of the awkward interface of performer and motor and the unvarying repetitive, rotational nature of the method of producing the vibrato. These basic musical deficiencies are why the vibraphone is described as "cool and detached" to most listeners, rather than "warm and expressive".

In recent years some improvements have been attempted to the interface of the player with the motor. While most professional quality vibraphones have an adjustable speed motor, the adjustment is imprecise and requires the performer to adjust the controls of the motor while commonly holding four mallets: two in each hand. One such attempted improvement gives the musician the ability to turn the motor on or off using a single strike of the mallet. Another attempted improvement allows the player to pre-set two speeds of the motor, either of which can be selected by the player with a single strike of the mallet or by passing the hand through the beam of a photoelectric switch. In either of these cases however, the speed of the motor, once started, is not linked in any way to the background rhythm or tempo of the music, nor is it responsive to the ebb and flow of the tension and release of individual notes, chords and passages. In one early design of the vibraphone, a button was mounted on the damper pedal, the purpose of which was limited to temporarily speeding up the motor to its maximum for a momentary fluttering special effect.

In each of these cases, the attempted improvement in the interface does not even contemplate note-to-note, moment-to-moment real time control of the speed or depth of the vibrato. However, anything short of complete control leaves the keyboard percussionist's control of vibrato in the realm of a "special effect" rather than elevating vibrato to an integral part of the creative process of making music, as it already is with the human voice or any string, woodwind and brass instrument.

Accordingly, it would be desirable to provide new methods and apparatus for creating vibrato in keyboard percussion instruments and the instrument-musician interface.

SUMMARY

In accordance with one aspect of the present invention, methods and apparatus are provided for controlling vibrato effects in key percussion instruments. In a first apparatus embodiment, a keyboard percussion instrument is provided which comprises at least one tone bar disposed over a resonator tube having a first opening, a tube cover which is configured to cover at least a portion of the first opening, the cover being moveable between a first position and a second position in which a greater or lesser portion of the first opening is covered than when the tube cover is in the first position, and a plurality of positions between the first and the second positions, and an actuator mechanism adapted to allow a user to manually control the position of the tube cover. In certain embodiments, there are a plurality of tone bars and resonator tubes, and the keyboard percussion instrument is selected from a vibraphone, marimba, xylophone, and glockenspiel.

According to at least one embodiment, the first position leaves the first opening completely uncovered and the second position fully covers the first opening. In one embodiment, the actuator mechanism includes a leaf spring operably connected to the tube cover. In another embodiment, the actuator mechanism includes a rod or cable operably connected to the tube cover. In embodiments that include a rod or cable, the actuator mechanism may further include a foot pedal operably connected to the cable.

In one or more embodiments, the tube cover comprises a disk operably connected to the actuator mechanism and manually movable between the first and second position. In certain embodiments, the tube cover is larger than the first opening.

According to one or more embodiments, the actuator includes an electrical motor operably connected to the tube cover to allow the user to control the covering position in a plurality of discrete locations. In certain embodiments, the tube cover is a plate that moves between the first and second positions in a non-rotational movement. In some embodiments, the tube cover is a plate having a nonlinear edge. In other embodiments, the tube cover is comprised of two plates that converge from opposite sides over the first opening when actuated by the actuator.

In certain embodiments, the actuator mechanism includes a pull mechanism operably connected to the tube cover. In some embodiments, the actuator mechanism may further include a foot pedal operably connected to the pull mechanism. In one or more embodiments including a foot pedal, the foot pedal may include at least two pivots, and one of the pivots varies leverage of the pedal based upon the position of the pedal.

In certain embodiments including a pedal, the pedal is operably connected to a tone bar damper. In such embodiments, the pedal may engage the tone bar damper when the pedal is in a first pedal position, and the pedal may engage the tube cover when the pedal is in a second pedal position. In these embodiments, the first pedal position and second pedal position can be in the same rotational plane of motion. In other embodiments, the first pedal position and second pedal position are in different planes of motion. In certain embodiments including a pedal, the pedal is configured to be positioned on a floor and has a heel portion that is raised from the floor.

Another aspect of the invention pertains to a method for controlling a vibrato effect in a keyboard percussion instrument having resonator tubes each having a first opening. One embodiment of the method includes manually controlling movement of a tube cover among a plurality of discrete locations to change the amount the first opening is covered by the tube cover. According to one more method embodiments, the keyboard percussion instrument is selected from a vibraphone, a marimba, a xylophone and a glockenspiel. In certain method embodiments, manual control may include a foot pedal operably connected the tube cover. In one or more method embodiments, manual control includes rotational movement of the foot pedal. In other method embodiments, manual control includes linear movement of the foot pedal.

DETAILED DESCRIPTION

Before describing several exemplary embodiments of the invention, it is to be understood that the invention is not limited to the details of construction or process steps set forth in the following description. The invention is capable of other embodiments and of being practiced or being carried out in various ways.

Figure 1:
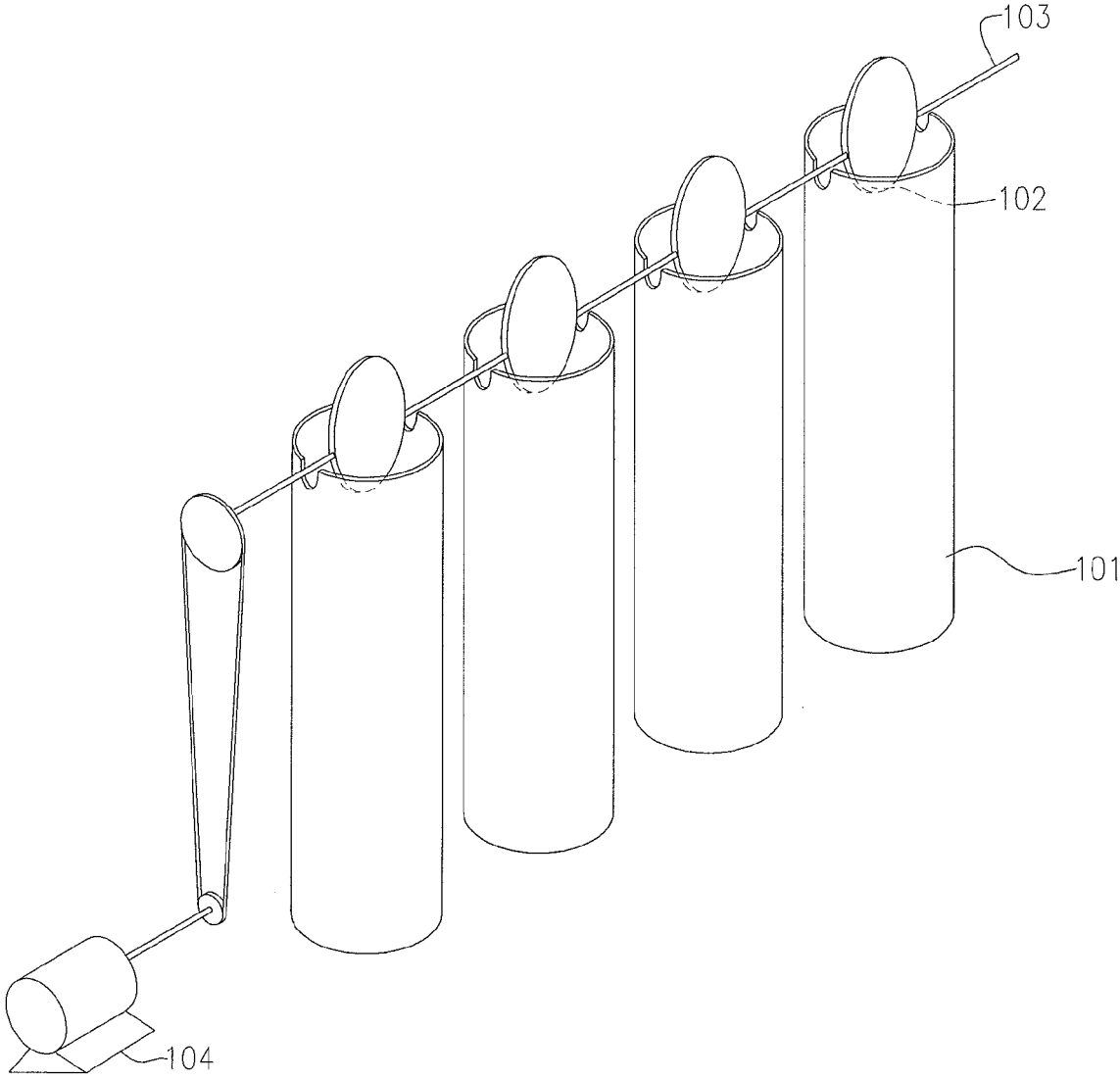
(PRIOR ART) FIG. 1
FIG. 1 shows a prior art vibrato mechanism with rotating pulsar disks.
Figure 2A:
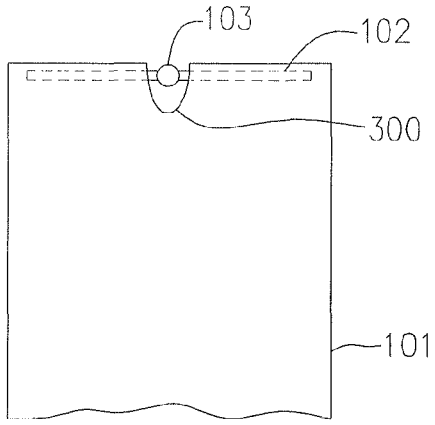
(PRIOR ART) FIG. 2a
FIGS. 2*a*, 2*b* and 2*c* show prior art pulsar disks in different positions.
Figure 2B:
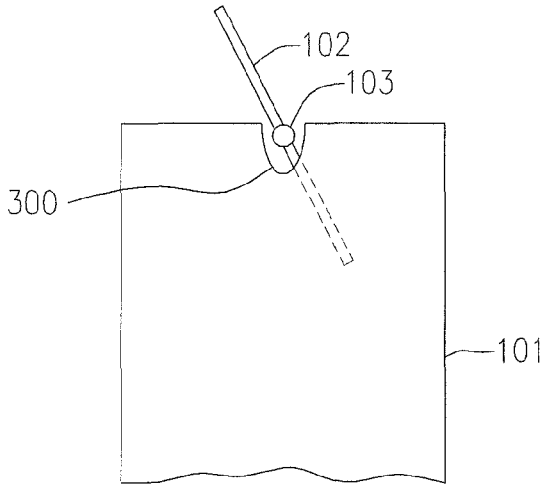
(PRIOR ART) FIG. 2b
Figure 2C:
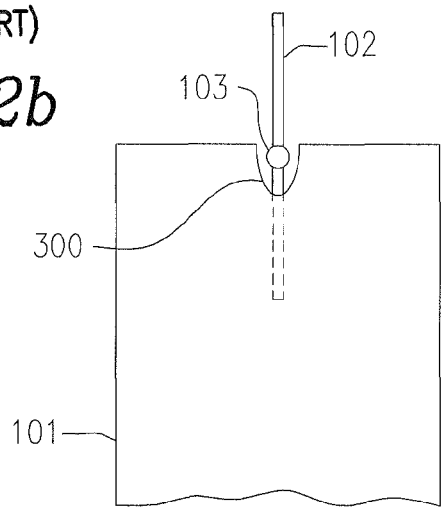
(PRIOR ART) FIG. 2c
Figure 3:
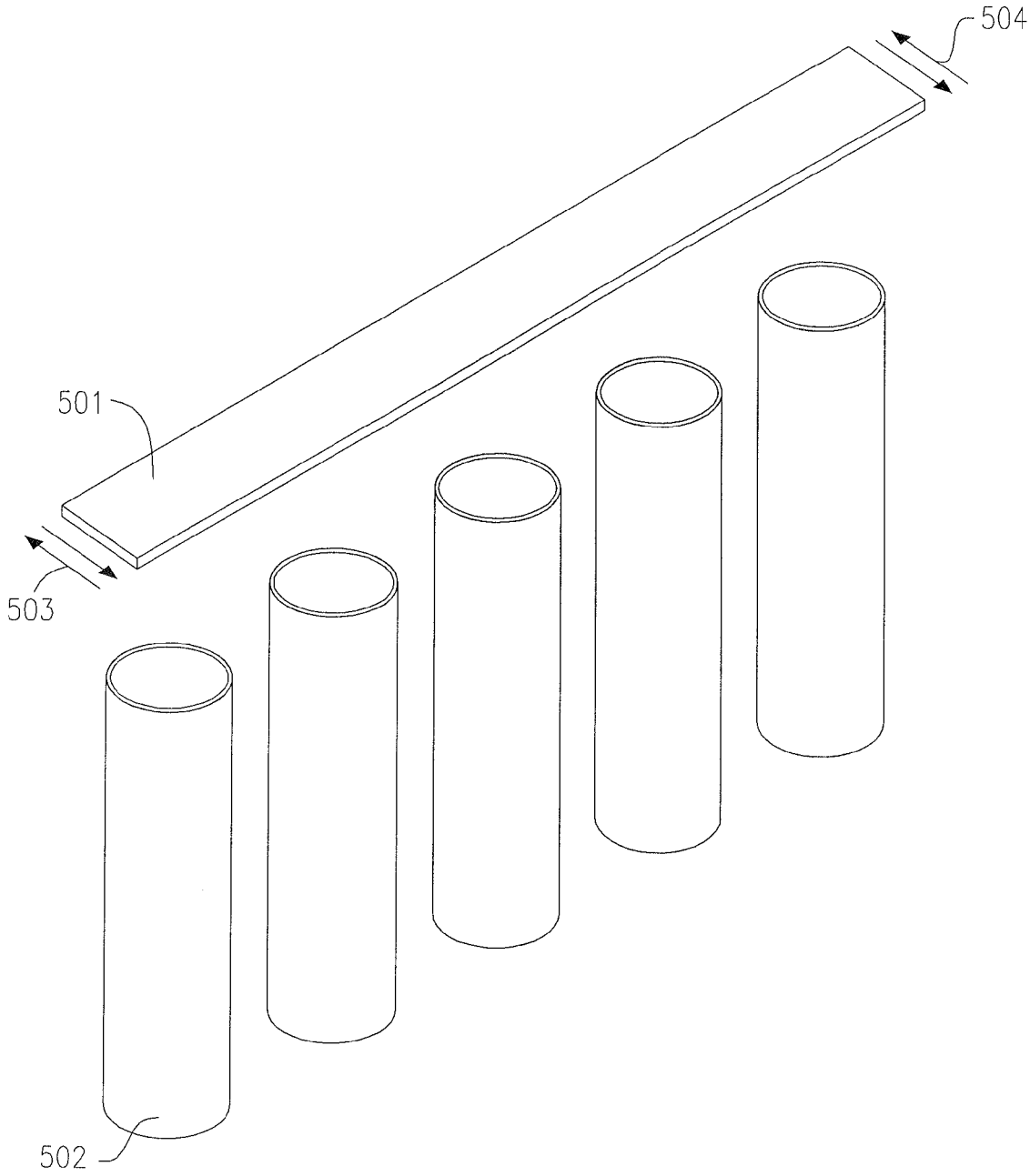
FIG. 3 shows a tube cover in accordance with an embodiment of the present invention.

Embodiments of the present invention are principally illustrated by examples using keyboard percussion instruments that customarily have resonator tubes, although other instruments may also benefit from aspects of the present invention, and these benefits are fully contemplated. In accordance with one aspect of the present invention, one element of the improved keyboard percussion instrument pertains to an improved method of producing the vibrato effect. In one embodiment as shown in diagram in FIG. 3, the motorized spinning disks mounted on a shaft are replaced by one or more rectangular flat panels 501 that can cover or expose the underlying resonator, for instance tube 502 by reciprocating movement perpendicular to the plane of the length of the tube. The possible movement direction of a plate 501 is indicated by arrows 503 and 504.

Figure 4:
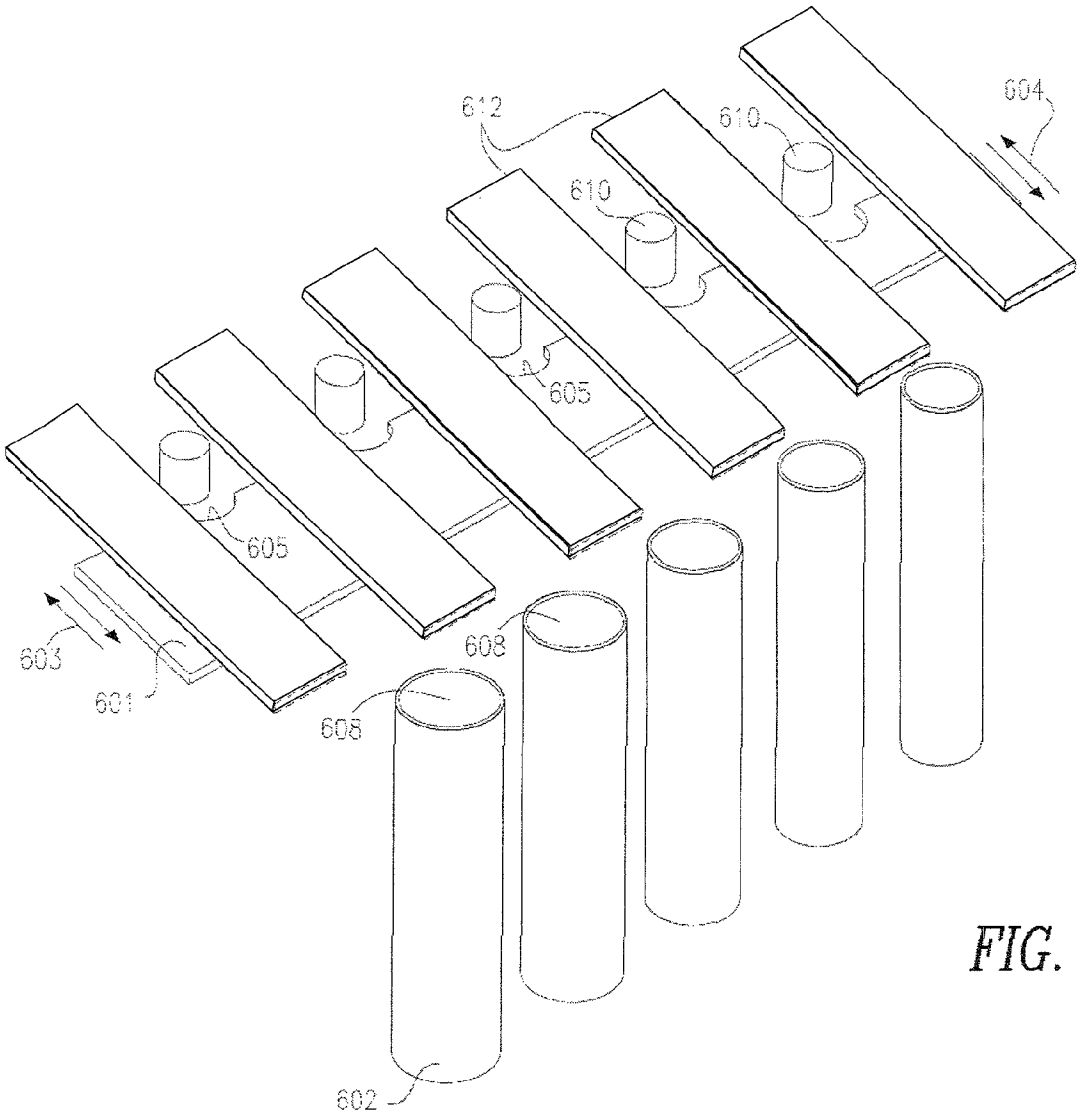
FIG. 4 shows a tube cover in accordance with another embodiment of the present invention.

Several methods will now be provided in accordance with different aspects of the present invention. In a typical application of a keyboard percussion instrument in which there are two ranks of bars and tubes (sharps and naturals), the plates can move in parallel motion or in contrary motion. FIG. 4 diagrammatically depicts a single plate for each set of tubes. In such an arrangement, there may not be room for a sufficiently sized plate in the limited space available in the high register of commonly constructed instruments. Accordingly, in the embodiment shown in FIG. 4, the panel 601 that covers the open end 608 of resonator tubes 602 is formed with a relieved or scalloped edge 605, which fits between and under each support 610 for the tone bars 612. The direction of movement of the plate 601 is identified by arrows 603 and 604. This scalloped or relieved vibrato plate shape provides additional coverage area so that the open end of each resonator can be both fully covered and fully exposed by the reciprocating motion of a plate.

Figure 5:
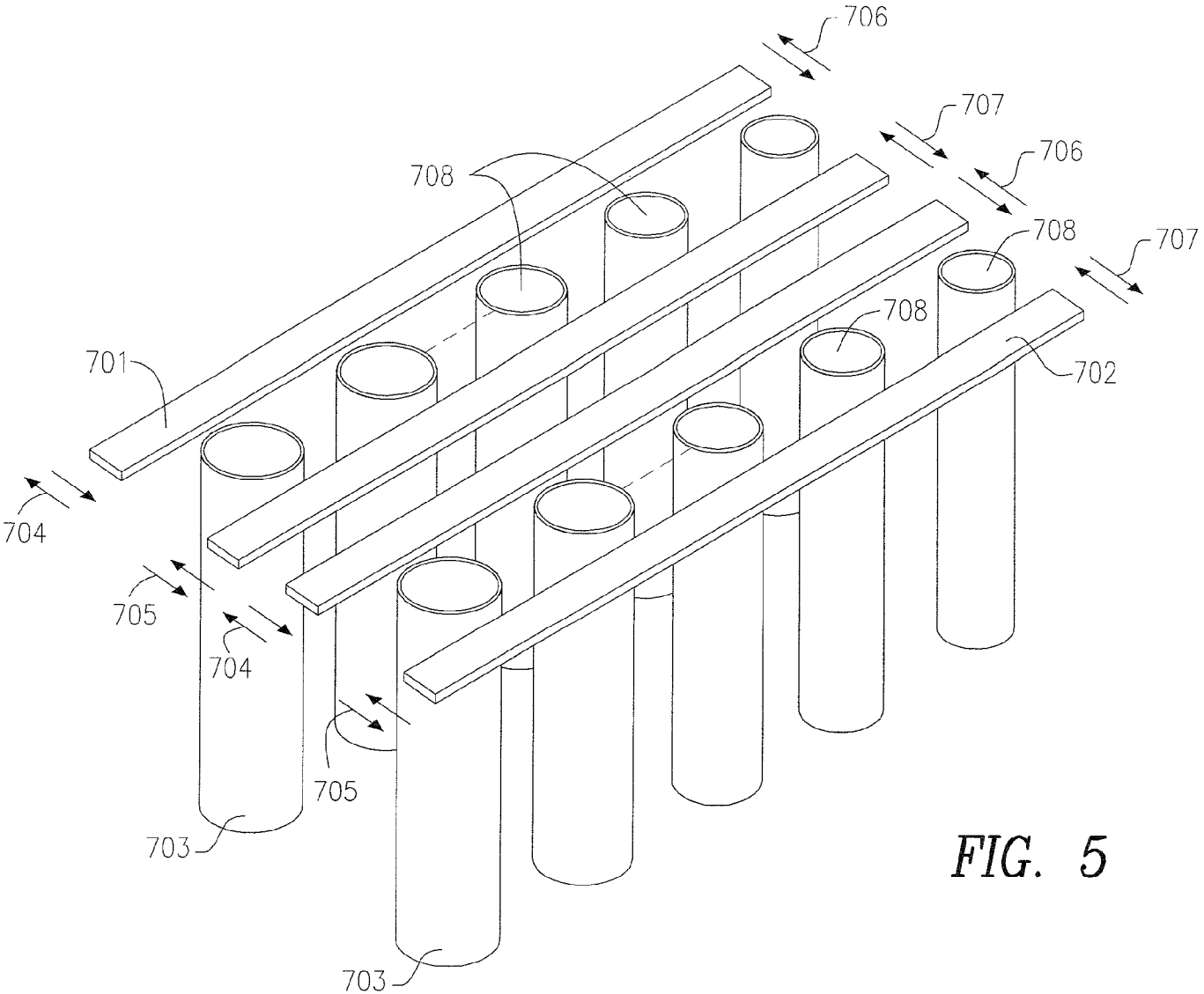
FIG. 5 shows a tube cover arrangement in accordance with yet another embodiment of the present invention.

In another embodiment as shown diagrammatically in FIG. 5, two panels 701 and 702 converge from opposite sides over open ends 708 of the tubes 703. Possible direction of movement of plates 701 and 702 are identified by arrows 704, 705, 706 and 707. In one embodiment shown in FIG. 5, two flat plates that slide towards each other over the open ends of the resonators replace the existing pulsar fan mechanism for creating vibrato. These plates move in contrary motion, completely closing the tubes when the plates meet in the center of the tubes. In yet another embodiment, a flexible pleated fabric or hinged multi-part solid panel is used to close off the tops of the resonators: when the tubes are in the open position, the fabric or panels fold out of the way of the tubes and structural members.

Embodiments of the present invention allow for continuous alterations of discrete positions of the tube cover, at the will and control of the player, in real time, at any practical speed with any desired degree(s) of depth, continuously changing those degrees if desired. As used herein, "manually" and "manual" are intended to mean using appendages such as hand or foot, arm or leg and also the head or any part of the body that can effect a change. Any limitation on the speed or frequency of change of position then depends on the technical capabilities of the musician to change position of the controlling limb or appendage.

It will be appreciated that some body parts, like fingers, can be changed in position much more rapidly than for instance a leg. It will also be appreciated that controlling forces exerted by these body parts are significantly different in magnitude. In one embodiment of the present invention, a servo mechanism can be utilized as an actuator of the vibrato cover or prior art pulsar disk assembly. This means that the force exerted on a manual controller can be greatly magnified and is of less importance. For instance, the controller in one embodiment can be a positional controller, which detects the position of for instance a foot or the change of the position of a foot. Such a controller can be embedded in a pedal. The controller can also be linked to the player with a wireless connection. In one embodiment, it can be linked to the player's shoe.

In an embodiment utilizing a substantially flat tube cover as described above, the method of moving the plate in accordance with a further aspect of the present invention can utilize a single pull or double pull to move the tube covers. Those skilled in the art will appreciate that the high register tubes, being much smaller in diameter than the low register tubes, require a smaller range of motion of the vibrato plate than the lower register tubes. For example in a typical application, the high register tubes have an approximate diameter of 1.5 inches and the low register tubes have an approximate diameter of 3 inches. In this example, the distance moved by the two opposite ends of the plate must have a 2:1 ratio. This can be accomplished in several ways.

Figure 6:
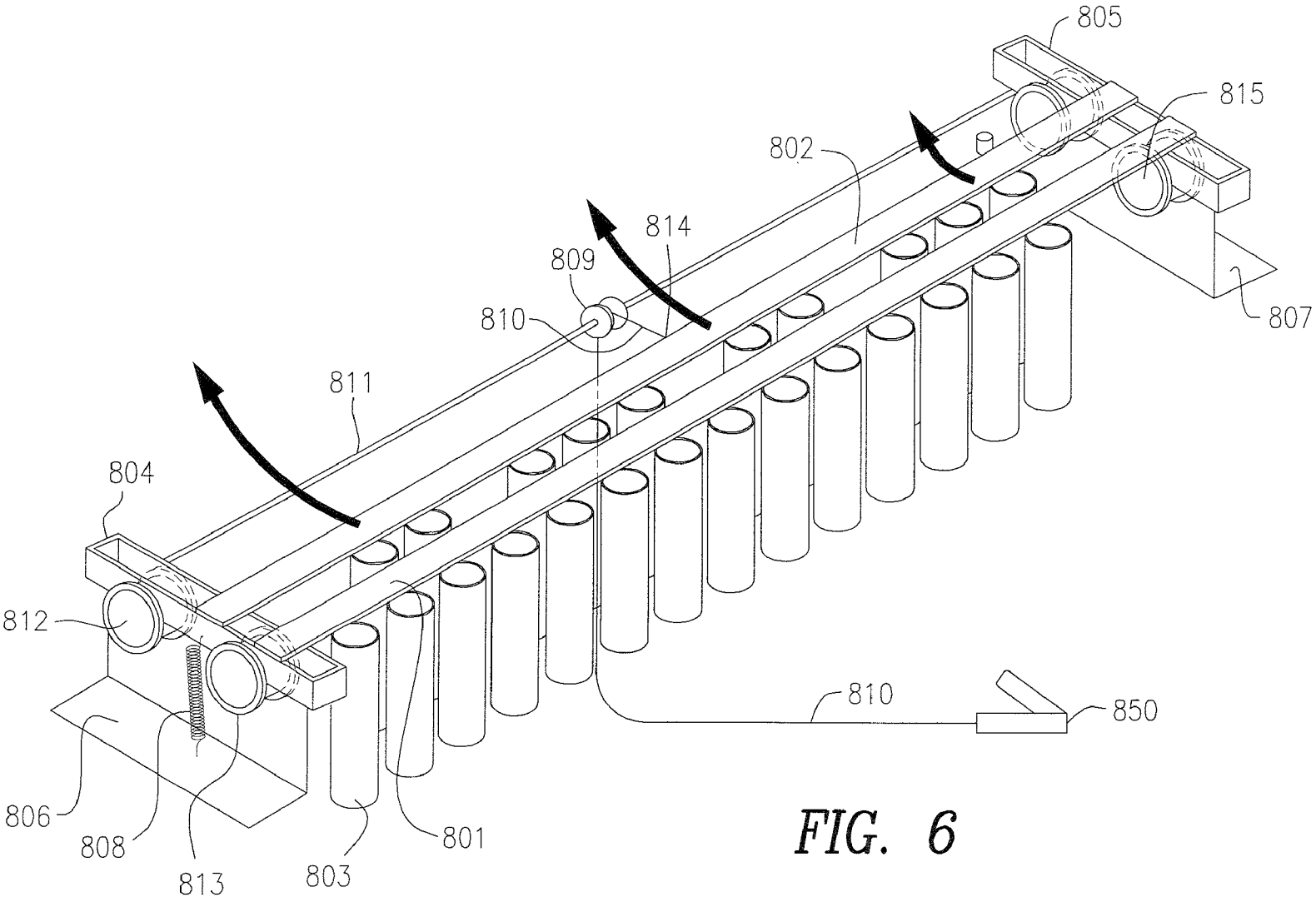
FIG. 6 shows a tube cover arrangement in accordance with yet another embodiment of the present invention.

Referring now to FIG. 6, in which an embodiment of a single plate cover for each rank or set of tubes is shown, a single pull, approximately centrally located on one or both of the plates is provided. As shown in FIG. 6, cover plates or shutters 801 and 802 are positioned over the resonator 803. Both ends of the shutters 801 and 802 are shown as attached to rolling supports 804 and 805. The supports 804 and 805 are respectively carried by shutter system platforms 806 and 807. A cable 810, which may be connected to a pedal 850 or other suitable control interface is connected to cover plate or shutter 802. The cable 810 is shown as passing over a pulley 809, which is fixed on an axle 811 supported by the instrument frame (not shown). It will be appreciated that the cable 810 could be fixed to the other cover plate or shutter 801 instead of the cover plate or shutter 802. Rollers 813, 815, carry support 805, and rollers 812, 813, carry support 804, which allow the plates or shutters 801, 802 to move over the resonator tubes 803. A spring 808 or any other suitable biasing mechanism provides return force to move the shutters or plates back over the tubes after the shutters or plates have been moved away from the resonator tubes 803.

In one embodiment, the arrangement shown in FIG. 6 can be combined with curved, low friction, support tracks for the covers or shutters to ride upon, with the high end track being a short curve and the low end track being a longer curve. In another embodiment, unequal length levers pull the top and bottom ends of the covers or shutters, directly coupled, or through cables. The exact travel distance needed for the top and bottom ends of each instrument can be calculated and appropriate length levers can be incorporated into the control mechanism.

Figure 7:
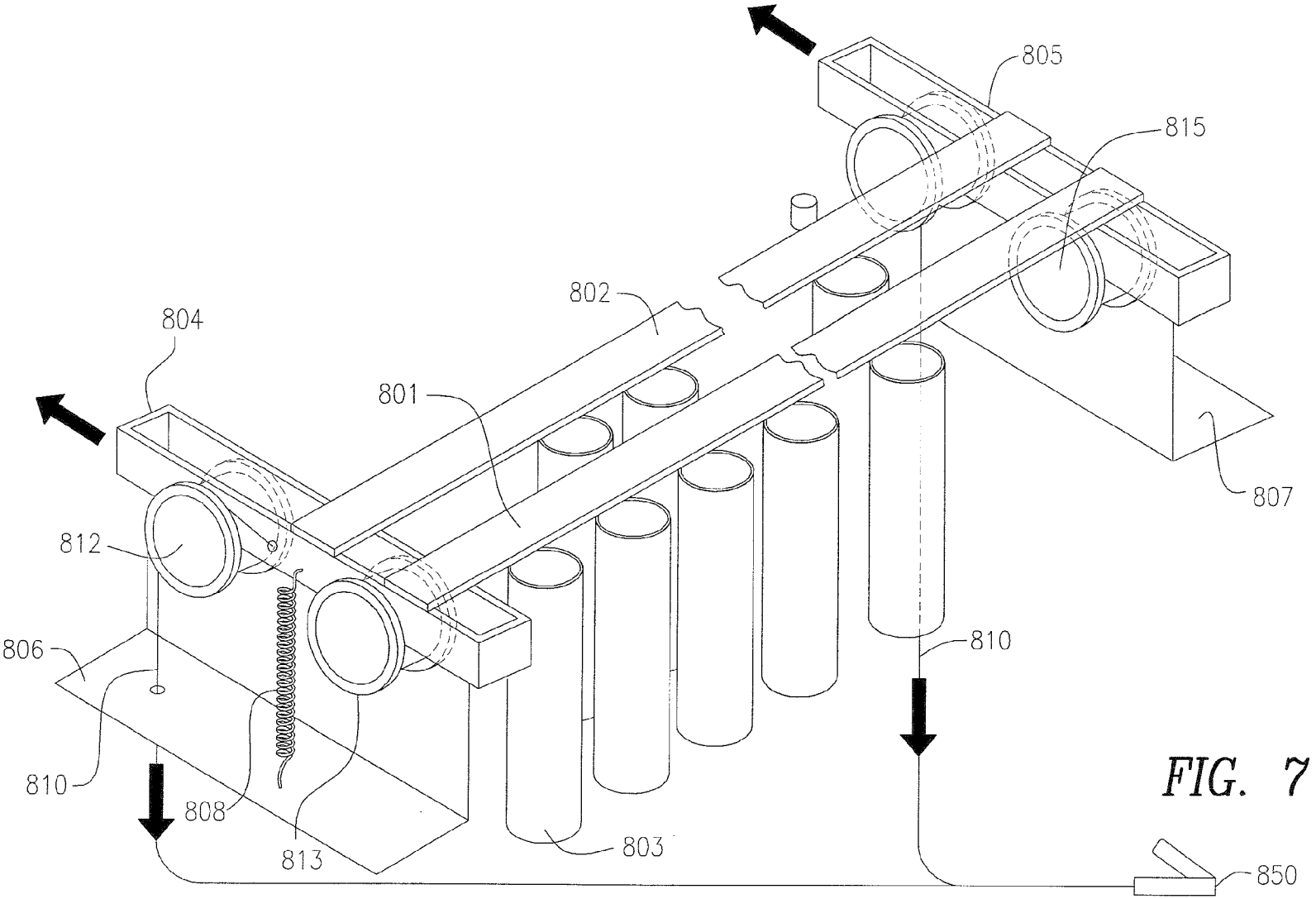
FIG. 7 shows a tube cover arrangement in accordance with still another embodiment of the present invention.

In an alternative embodiment shown in FIG. 7, in which like elements are numbered the same as in FIG. 6, a double pull mechanism is shown. In this embodiment, two cables 810 are connected to two connection points 814. In the embodiment shown in FIG. 7, the cables 810 are shown as being attached to supports 804, 805, but it will be appreciated that the cables could be attached to one of the plates 801, 802. The cables are operatively connected to foot pedal 850 or other suitable player control interface.

It will appreciated that various modifications can be made to the embodiments shown in FIGS. 6 and 7. For example, the supports 804, 805 could be replaced by shutter support belts looped around the pulley, and the belt. The cable may be attached to part of the shutter belt and or to the pulley in order to move the belt.

Figure 8:
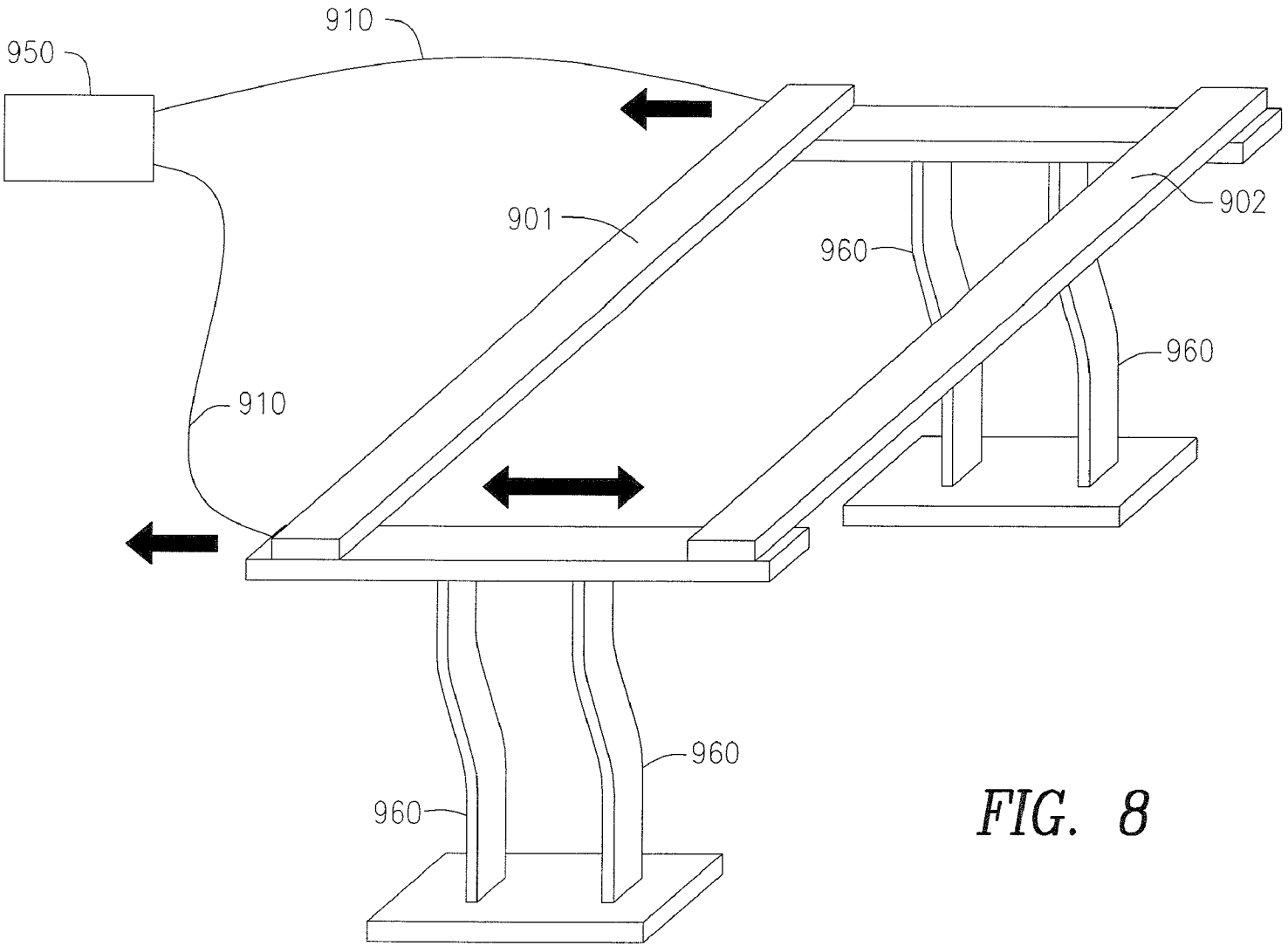
FIG. 8 shows a leaf spring based mechanism in accordance with one embodiment.

In yet another embodiment shown in FIG. 8, resonator tube covers or plates 901, 902 are mounted on parallel flat springs or leaf springs 960 that serve as both the supporting structure and the energy needed to return the plates to their original position after the player has moved the covers or plates 902. As in the previously described embodiments, the tube covers or plates 901, 902 may be moved by a cable 910 connected to a control interface 950 operated by the player of the instrument. The control interface 950 may be a pedal.

In an alternative embodiment, the covers or plates are mounted to and travel upon a bar that rides on low friction rollers. In any of these embodiments, the motion of the musician's foot, arm, knee or other body part, can be transferred to the mechanism by direct pull on a solid rod, a cable connection, a wireless connection, or many other means that will be apparent to anyone skilled in the art.

Not only are the methods of producing vibrato described above both simpler and less expensive to produce (because of fewer parts compared to the pulsar fan assembly), this method of producing vibrato is also much quieter than the existing art motorized method. In accordance with one other aspect of the present invention a method and apparatus is provided for controlling the depth or strength of the vibrato effect. A non-rotational method of producing the tube closure described above allows the strength of vibrato to be controlled separately from the speed. If the shutter is fluttered over the tubes but only covers 20% of the area of the open pipe, the effect will be "shallow". If the shutter is manipulated to fully close and then open the tube, the effect will be "deep" and profound. This is similar to the variations in vibrato a violinist can achieve by gently rocking the finger for a "shallow" vibrato or by a stronger motion, which will produce a more pronounced effect.

According to one or more embodiments of the present invention, the player of the instrument is provided with the ability to crescendo a note or chord after the tone bar is struck. In most struck or plucked instruments (such as keyboard percussion instruments, but also piano, harp and acoustic guitar) the initial sounding of the note by the mallet (or finger in the case of the other instruments) produces the greatest perceived volume. Immediately thereafter, the note begins to decay toward inaudibility. There has been no acoustic way to increase the volume of a note that has already begun, without striking the tone bar again. In accordance with another aspect of the present invention, different manners and combinations of crescendos and diminuendos are provided without re-striking or dampening the tone bars. For example, when the tone bar is struck with the shutter mechanism closed, anytime afterward (while the note is still ringing) the shutter can be opened and the note will dramatically crescendo through the amplifier effect of the resonator tube. Likewise, anytime after a note or chord is struck, the resonators can be closed off, producing a quick or slow decrescendo.

While the embodiments described above show and describe substantially flat or elongate plates for achieving the vibrato effect, it will be appreciated that a conventional instrument with pulsar disks can be manually controlled similar to the embodiments described above. Thus, as used herein, the terms "tube cover," "resonator cover" and the like refer to any type of structure that covers a resonator tube, including traditional disks and the elongate plates described herein. Thus according to certain embodiments of the invention, the need for a motor is alleviated entirely because the motion of the foot, arm or toe of the player directly actuates the motion of the pulsar fans. It should be noted that it is not necessary for the pulsars to make complete 360 degree revolutions to achieve vibrato. The movement of the pulsar disks can be accomplished in an oscillating fashion with the pulsar disks moving only 90-degrees to the closed position before returning to the open position, as controlled by the user. The user can control the degree of opening and closing of the pulsar disks in discrete movements. This motion can be actuated by any suitable control mechanism. The control mechanism can be separate from, or integral with, the instruments damper pedal itself.

Figure 9:
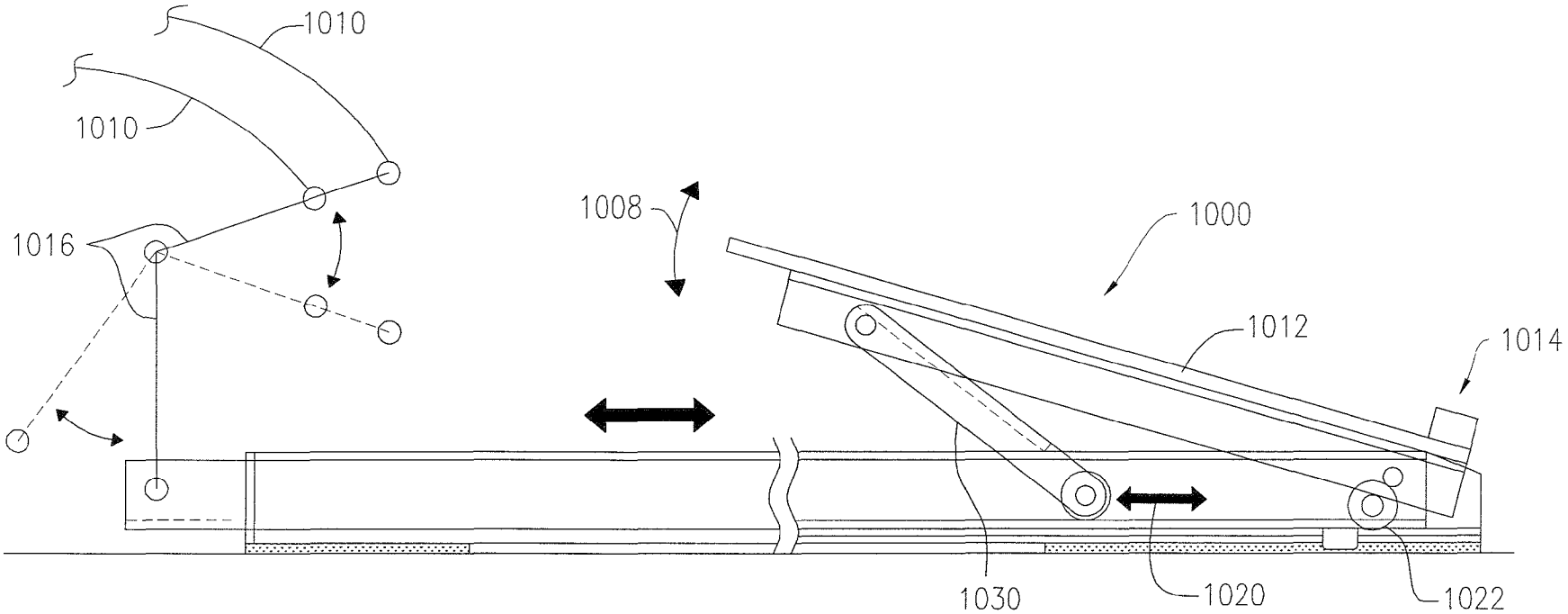
FIG. 9 shows a pedal control in accordance with an embodiment of the invention.

In one or more embodiments of the invention, the control of vibrato is provided by a pedal interface, an exemplary embodiment being shown in FIG. 9. In certain embodiments, a pedal separate from the damper pedal on the instrument can be provided to control vibrato. In certain embodiments, control of vibrato can be integrated with the instrument's damper pedal. In embodiments that provide control of vibrato and the damper mechanism, the control of vibrato can be in the same plane of motion as control of the damper. For example, the player of the instrument could control damper by application of foot pressure for a first range of motion downwardly on the pedal. Thereafter, the player could apply further downward pressure on the pedal to control the tube covers to achieve vibrato. In a particular embodiment, the first zone (for example the first inch of range of motion) operates the damper mechanism in the traditional way. After passing the 1-inch range (the damper bar is now no longer in contact with the tone bars and they are ringing freely), the pedal engages the vibrato mechanism. The second zone (for example the second inch of range of motion) operates the vibrato effect. While this embodiment eliminates the possibility of operating the vibrato with the damper in contact with the tone bars, it simplifies the interface of player and instrument. In this embodiment the player merely moves the pedal up and down to operate the damper, and further up and down to add vibrato.

In the embodiment shown in FIG. 9, a pedal 1000 is shown, which provides the damper is operated by up and down rotational motion indicated by arrow 1008. In use, the player's foot would be placed on the platform 1012 and the heel of the player's foot would rest against heel rest 1014 elevated from the floor. A cable (not shown) or other suitable linkage connected to the pedal would actuate the damper of the instrument as is presently achieved in percussion instruments such as vibraphones. In the embodiment shown, the pedal is also permitted to slide axially in the direction of arrow 1020 because the pedal is mounted on one or more rollers 1022. It will be appreciated that the pedal could be mounted on a roller track or any other suitable sliding track that would allow for axial motion of the pedal, which controls movement of a lever 1016. A separate cable 1010 or other suitable linkage connect from the lever to the tube covers of the instrument allows the player to move the tube covers to achieve vibrato effect by sliding the pedal axially back and forth in the directions shown by arrow 1020. In other embodiments, these controls could be reversed so that axial movement of the pedal controls the damper while rotational movement the pedal controls vibrato. In still other embodiments, the vibrato can be controlled by moving in some other plane (for example left to right), or by an additional interface, separate from the damper pedal.

In another embodiment of the interface, the damper mechanism is improved by means of a moving pedal lever 1030. In this embodiment, the increasing resistance of the springs in the damper bar mechanism (not shown) are compensated for by the moving pedal lever 1030 positioned beneath the pedal 1012 that proportionally increases the leverage of the pedal as it is depressed. In this embodiment, the lever effectively lengthens, as the damper springs are compressed. According to one or more embodiments that utilize a moving pedal lever, the "feel" and control of the pedal is improved because the resistance felt by the player is substantially the same in all positions—whether the springs are only slightly compressed, or fully compressed. In addition, the leverage afforded by the moving pedal lever, according to certain embodiments, lessens the effort needed to manipulate the damper. In one or more embodiments, when vibrato control is added to this embodiment, the resistance and "push back" of the pedal system in the down position is greatly reduced, allowing for much easier and faster manipulation of the vibrato effect.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

The invention claimed is:

1. A keyboard percussion instrument comprising:

at least one tone bar disposed over at least one resonator tube having a first opening;

a tube cover which is configured to cover at least a portion of the first opening, the cover being moveable between at least a first position and a second position in which a greater or lesser portion of the first opening is covered than when the tube cover is in the first position, and a plurality of positions between the first and the second positions; and an actuator mechanism adapted to allow a user to manually control movement of the tube cover through intermediate positions between the first position and the second position such that changes in position of the tube cover correspond in real-time and are proportional to any changes in position of a body part of the user when the body part actuates the actuator mechanism, the actuator mechanism including a foot pedal and a pull mechanism coupling the foot pedal to the tube cover such that a force applied by a user to the foot pedal is transferred mechanically by the foot pedal and by the pull mechanism to the tube cover such that the change in position of the user directly moves the tube cover without the use of an electric motor.

2. The keyboard percussion instrument as claimed in claim 1, wherein the keyboard percussion instrument is selected from a vibraphone, marimba, xylophone, and glockenspiel.

3. The keyboard percussion instrument as claimed in claim 1, wherein, in the first position, the tube cover is laterally offset from an axis of the resonator tube such that the first opening is completely exposed to the tone bar and, in the second position, the tube cover is interposed between the tone bar and the resonator tube such that the tube cover at least partially covers the first opening.

4. The keyboard percussion instrument as claimed in claim 1, wherein the actuator mechanism includes a leaf spring operably connected to the tube cover.

5. The keyboard percussion instrument as claimed in claim 1, wherein the tube cover comprises a disk operably connected to the actuator mechanism and manually movable between the first and second position.

6. The keyboard percussion instrument as claimed in claim 1, wherein the tube cover is a plate that moves between the first and second positions in a non-rotational movement.

7. The keyboard percussion instrument as claimed in claim 1, wherein the tube cover is a plate having a nonlinear edge.

8. The keyboard percussion instrument as claimed in claim 1, wherein the tube cover is comprised of two plates that converge or diverge from opposite sides over the first opening when actuated by the actuator.

9. The keyboard percussion instrument as claimed in claim 1, wherein the foot pedal includes at least two pivots, and one of the pivots varies leverage of the pedal based upon the position of the pedal.

10. The keyboard percussion instrument as claimed in claim 9, wherein the pedal is operably connected to a tone bar damper.

11. The keyboard percussion instrument as claimed in claim 10, wherein the pedal is operably connected to the tone bar damper and the tube cover such that the pedal engages the tone bar damper when the pedal is in a first pedal position, and the pedal engages the tube cover when the pedal is in a second pedal position.

12. The keyboard percussion instrument as claimed in claim 11, wherein the first pedal position and second pedal position are in the same rotational plane of motion.

13. The keyboard percussion instrument as claimed in claim 11, wherein the first pedal position and second pedal position are in different planes of motion.

14. The keyboard percussion instrument as claimed in claim 1, wherein the pedal is configured to be positioned on a floor and has a heel portion that is raised from the floor.

15. The keyboard percussion instrument as claimed in claim 1, wherein the tube cover is larger than the first opening.

16. The keyboard percussion instrument as claimed in claim 1, wherein the tube cover comprises a circular disk disposed within the first opening of the resonator tube.

17. The keyboard percussion instrument as claimed in claim 16, wherein the pull mechanism is coupled to the circular disk such that the pull mechanism is operable to rotate the disk in a first direction from the first position to the second position and operable to rotate the disk in a second direction from the second position to the first position, the second direction being opposite the first direction.

18. The keyboard percussion instrument as claimed in claim 6, wherein the pull mechanism is coupled to the plate such that the plate moves laterally to an axis of the resonator tube.

19. A method for controlling a vibrato effect in a keyboard percussion instrument having resonator tubes each having a first opening, comprising:

manually controlling movement of a tube cover among a plurality of discrete locations to change an amount the first opening is covered by the tube cover by actuating an actuator mechanism, wherein manually controlling movement of the tube cover comprises moving the tube cover in at least one direction between at least a first position and a second position in which a greater or lesser portion of the first opening is covered than when the tube cover is in the first position and a plurality of positions between the first and second positions such that changes in position of the tube cover correspond in real-time and are proportional to any changes in position of a body part of a user when the body part actuates the actuator mechanism and such that the change in position of the user directly moves the tube cover without the use of an electric motor.

20. The method as claimed in claim 19, wherein the keyboard percussion instrument is selected from a vibraphone, a marimba, a xylophone and a glockenspiel.

21. The method as claimed in claim 19, wherein manually controlling movement of the tube covers includes operation of a foot pedal operably connected the tube cover.

22. The method as claimed in claim 21, wherein manually controlling movement includes rotationally moving the foot pedal.

23. The method as claimed in claim 22, wherein manually controlling movement includes linearly moving the foot pedal.

24. A keyboard percussion instrument comprising:

at least one tone bar disposed over at least one resonator tube having a first opening;

at least one circular disk disposed within the first tube opening and capable of rotating within the first tube opening; and an actuator mechanism adapted to allow a user to manually control rotation of the disk such that changes in position of the disk correspond in real-time and are proportional to changes in position of a body part of the user when the body part actuates the actuator mechanism, the actuator mechanism including a foot pedal and a pull mechanism coupling the foot pedal to the disk such that a force applied by a user to the foot pedal is transferred mechanically by the foot pedal and the pull mechanism to the disk such that the change in position of the user directly moves the disk without the use of an electric motor.

25. The keyboard percussion instrument as claimed in claim 24, wherein the pull mechanism is coupled to the disk such that the pull mechanism is operable to rotate the disk in a first direction from the first position to the second position and operable to rotate the disk in a second direction from the second position to the first position, the second direction being opposite the first direction.

* * * * *